US008053697B2

(12) United States Patent
Lin

(10) Patent No.: US 8,053,697 B2
(45) Date of Patent: Nov. 8, 2011

(54) KEYBOARD, LINKAGE ASSEMBLY SET, AND METHOD OF ASSEMBLING A KEYBOARD

(75) Inventor: Jyh-Tsong Lin, Taipei (TW)

(73) Assignee: Changshu Sunrex Technology Co., Ltd., Changshu (CN)

( * ) Notice: Subject to any disclaimer, the term of this patent is extended or adjusted under 35 U.S.C. 154(b) by 379 days.

(21) Appl. No.: 12/410,615

(22) Filed: Mar. 25, 2009

(65) Prior Publication Data

US 2010/0243420 A1 Sep. 30, 2010

(51) Int. Cl.
*H01H 13/7065* (2006.01)
*H01H 13/88* (2006.01)

(52) U.S. Cl. ..... 200/344; 29/622

(58) Field of Classification Search ..... 200/5 A, 200/517, 344; 400/490–496; 29/622
See application file for complete search history.

(56) References Cited

U.S. PATENT DOCUMENTS 5,901,837 A * 5/1999 Aimi ..... 200/344
6,150,624 A * 11/2000 Yao ..... 200/344
6,183,150 B1 * 2/2001 Kao ..... 400/495
6,236,003 B1 * 5/2001 Suganami ..... 200/5 A
6,504,121 B2 * 1/2003 Hasunuma ..... 200/344
6,633,012 B2 * 10/2003 Hsu ..... 200/344
6,733,196 B2 * 5/2004 Lee et al. ..... 400/480
7,332,687 B2 * 2/2008 Liu ..... 200/344
7,385,149 B2 * 6/2008 Liu ..... 200/5 A
7,683,280 B2 * 3/2010 Hsu ..... 200/344

* cited by examiner

*Primary Examiner* — Michael Friedhofer
(74) *Attorney, Agent, or Firm* — Harry K. Ahn; Abelman Frayne & Schwab

(57) ABSTRACT

A keyboard includes a keyboard base, a membrane circuit substrate, and a press key set having a plurality of press keys. Each of the press keys includes: a keycap, a linkage assembly including intersecting first and second link levers, and a first pivot mechanism to interconnect pivotally the first and second link levers, and an elastic element. The first pivot mechanism includes: a female element having a first opening formed in one of upper and lower surfaces of the first link lever; and a flexible male element outwardly protruding from a lateral surface of the second link lever. The male and female elements are configured such that after the male element is elastically deformed to be pressed into the female element via the first opening, the male element is restored to its original form to be limited in the female element.

5 Claims, 8 Drawing Sheets

KEYBOARD, LINKAGE ASSEMBLY SET, AND METHOD OF ASSEMBLING A KEYBOARD

BACKGROUND OF THE INVENTION

1. Field of the Invention

This invention relates to a keyboard, a linkage assembly set for coupling a plurality of keycaps to a keyboard base of a keyboard, and a method of assembling the keyboard.

2. Description of the Related Art

As shown in FIGS. 1 and 2, a conventional keyboard includes a keyboard base 11, a membrane circuit substrate 12 disposed on the keyboard base 11, an elastic sheet 13 disposed on the membrane circuit substrate 12, and a press key set (not shown) having a plurality of press keys 1 disposed on the elastic sheet 13. Each of the press keys 1 includes a keycap 15, a linkage assembly 16, and an elastic element 17.

In each of the press keys 1, the linkage assembly 16 is disposed under the keycap 15 and includes intersecting first and second link levers 161, 162, and a pivot mechanism to interconnect pivotally the first and second link levers 161, 162. The first and second link levers 161, 162 respectively define upper and lower ends 165, 167, 166, 168. By connecting pivotally and respectively the upper ends 165, 166 of the first and second link levers 161, 162 to the keycap 15, and by connecting pivotally and respectively the lower ends 167, 168 of the first and second link levers 161, 162 to the keyboard base 11, the keycap 15 is movable upwardly and downwardly relative to the keyboard base 11 by means of the linkage assembly 16.

In each of the press keys 1, the elastic element 17 is connected to the elastic sheet 13, passes upwardly through the linkage assembly 16, is connected to the keycap 15, and contacts the membrane circuit substrate 12 when the keycap 15 is pressed.

As shown in FIG. 1, the pivot mechanism includes: a female element 163 having a first opening in a lateral surface of the first link lever 161; and a male element 164 outwardly protruding from a lateral surface of the second link lever 162. Typically, the first and second link levers 161, 162 of each of the press keys 1 are respectively in a form of a frame with a hollow portion therein. Assembling one linkage assembly 16 inevitably is conducted by spreading apart the frame of the first link lever 161 for permitting the frame of the second link lever 162 to be inserted into the hollow portion of the first link lever 161, followed by releasing the frame of the first link lever 161 to let the male element 164 of the second link lever 162 to be sidewardly pressed into the female element 163 of the first link lever 161.

Therefore, it is necessary to assemble all of the linkage assemblies 16 one by one in the conventional keyboard. Furthermore, mounting the linkage assemblies 16 onto an assembly of the keyboard base 11, the membrane circuit substrate 12, and the elastic sheet 13 are also conducted one by one.

SUMMARY OF THE INVENTION

Therefore, an object of the present invention is to provide a keyboard, a linkage assembly set, and a method of assembling the keyboard that can overcome the aforesaid drawbacks associated with the prior art.

According to a first aspect of the present invention, there is provided a keyboard comprising: a keyboard base; a membrane circuit substrate disposed on the keyboard base; and a press key set having a plurality of press keys disposed on the membrane circuit substrate, each of the press keys including: a keycap; a linkage assembly disposed under the keycap and including intersecting first and second link levers, and a first pivot mechanism to interconnect pivotally the first and second link levers, the first and second link levers respectively defining upper and lower ends, the linkage assembly further including second and third pivot mechanisms that connect pivotally and respectively the upper ends of the first and second link levers to the keycap, the linkage assembly further including fourth and fifth pivot mechanisms that connect pivotally and respectively the lower ends of the first and second link levers to the keyboard base, the keycap being movable upwardly and downwardly relative to the keyboard base by means of the linkage assembly; and an elastic element that is disposed on the membrane circuit substrate, that passes upwardly through the linkage assembly to connect with the keycap, and that contacts the membrane circuit substrate when the keycap is pressed; wherein, among the first, second, third, fourth, and fifth pivot mechanisms, at least the first pivot mechanism includes: a female element having a first opening formed in one of upper and lower surfaces of the first link lever; and a flexible male element outwardly protruding from a lateral surface of the second link lever; and wherein the male and female elements are configured such that after the male element is elastically deformed to be pressed into the female element via the first opening, the male element is restored to its original form to be limited in the female element.

According to a second aspect of the present invention, there is provided a linkage assembly set for coupling a plurality of keycaps to a keyboard base of a keyboard. The linkage assembly set comprises a plurality of linkage assemblies and first and second bridging elements. Each of the linkage assemblies includes intersecting first and second link levers that are interconnected pivotally. The first link levers in each of the linkage assemblies are connected to one another by virtue of the first bridging element to be arranged in a row. The second link levers in each of the linkage assemblies are connected to one another by virtue of the second bridging element to be arranged in a row. The first link lever includes a female element having a first opening formed in one of upper and lower surfaces of the first link lever, and the second link lever includes a flexible male element outwardly protruding from a lateral surface of the second link lever. The male and female elements are configured such that after the male element is elastically deformed to be pressed into the female element via the first opening, the male element is restored to its original form to be limited in the female element, and the first and second link levers are interconnected pivotally.

According to a third aspect of the present invention, there is provided a method of assembling a keyboard, comprising the steps of: (a) preparing a plurality of linkage assembly sets, each of which includes a plurality of linkage assemblies and first and second bridging elements, each of the linkage assemblies including intersecting first and second link levers that are interconnected pivotally, the first link levers in each of the linkage assemblies being connected to one another by virtue of the first bridging element to be arranged in a row, the second link levers in each of the linkage assemblies being connected to one another by virtue of the second bridging element to be arranged in a row; (b) disposing a membrane circuit substrate on a keyboard base; (c) disposing a plurality of elastic elements on the membrane circuit substrate; (d) mounting the linkage assembly sets on an assembly of the keyboard base, the membrane circuit substrate and the elastic elements row by row, such that each of the linkage assemblies permits one of the elastic elements to pass upwardly therethrough; and (e) mounting a plurality of keycaps onto the linkage assemblies such that each of the keycaps is mounted on one of the linkage assemblies. The first link lever includes a female element having a first opening formed in one of upper and lower surfaces of the first link lever, and the second link lever includes a flexible male element outwardly protruding from a lateral surface of the second link lever. The male and female elements are configured such that after the male element is elastically deformed to be pressed into the female element via the first opening, the male element is restored to its original form to be limited in the female element, and the first and second link levers are interconnected pivotally.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
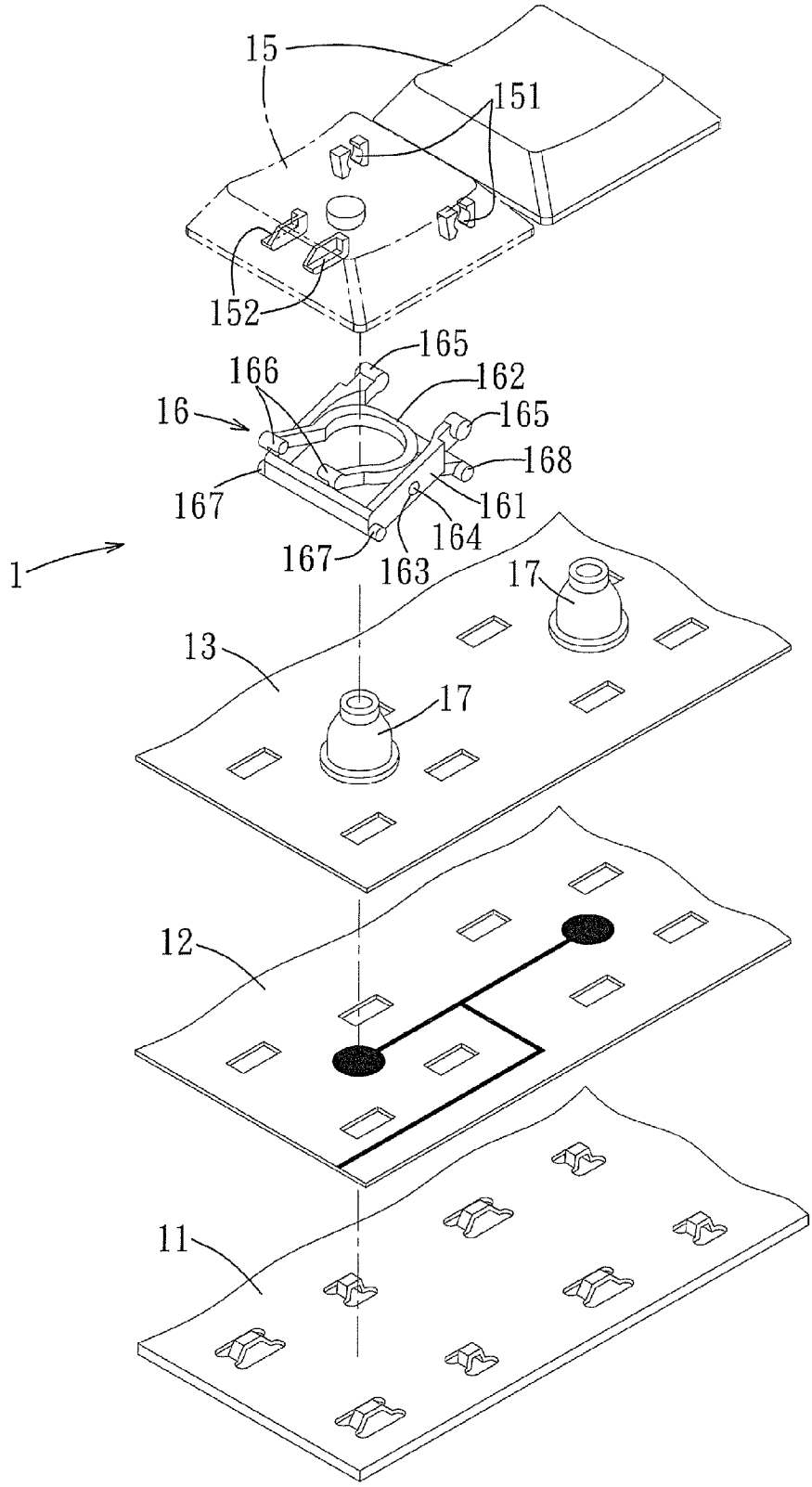
FIG. 1 PRIOR ART
FIG. 1 is a fragmentary exploded perspective view of a conventional keyboard.
Figure 2:
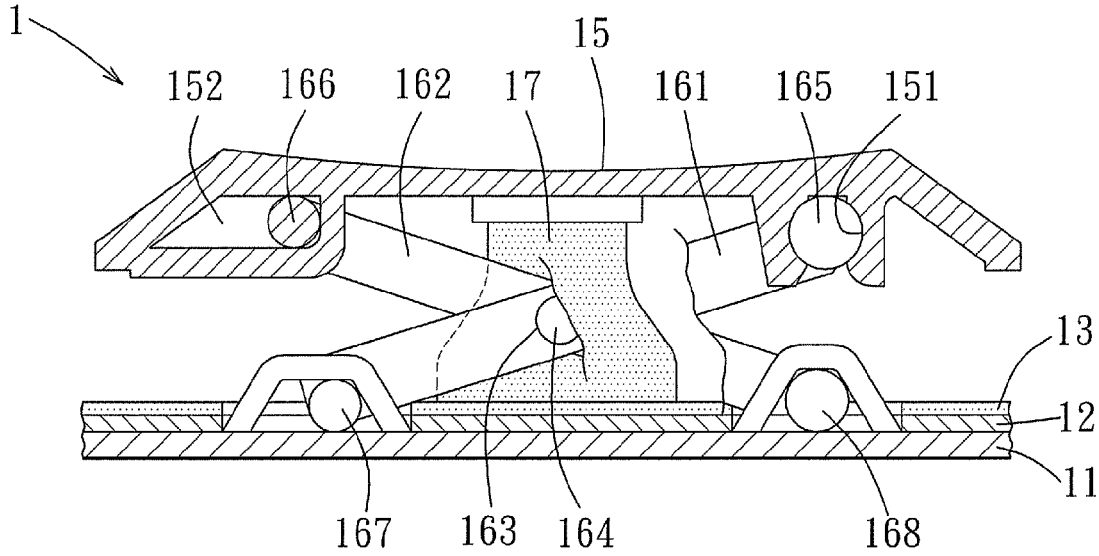
FIG. 2 PRIOR ART
FIG. 2 is a fragmentary cross-sectional view of the conventional keyboard of FIG. 1 in an assembled state.
Figure 3:
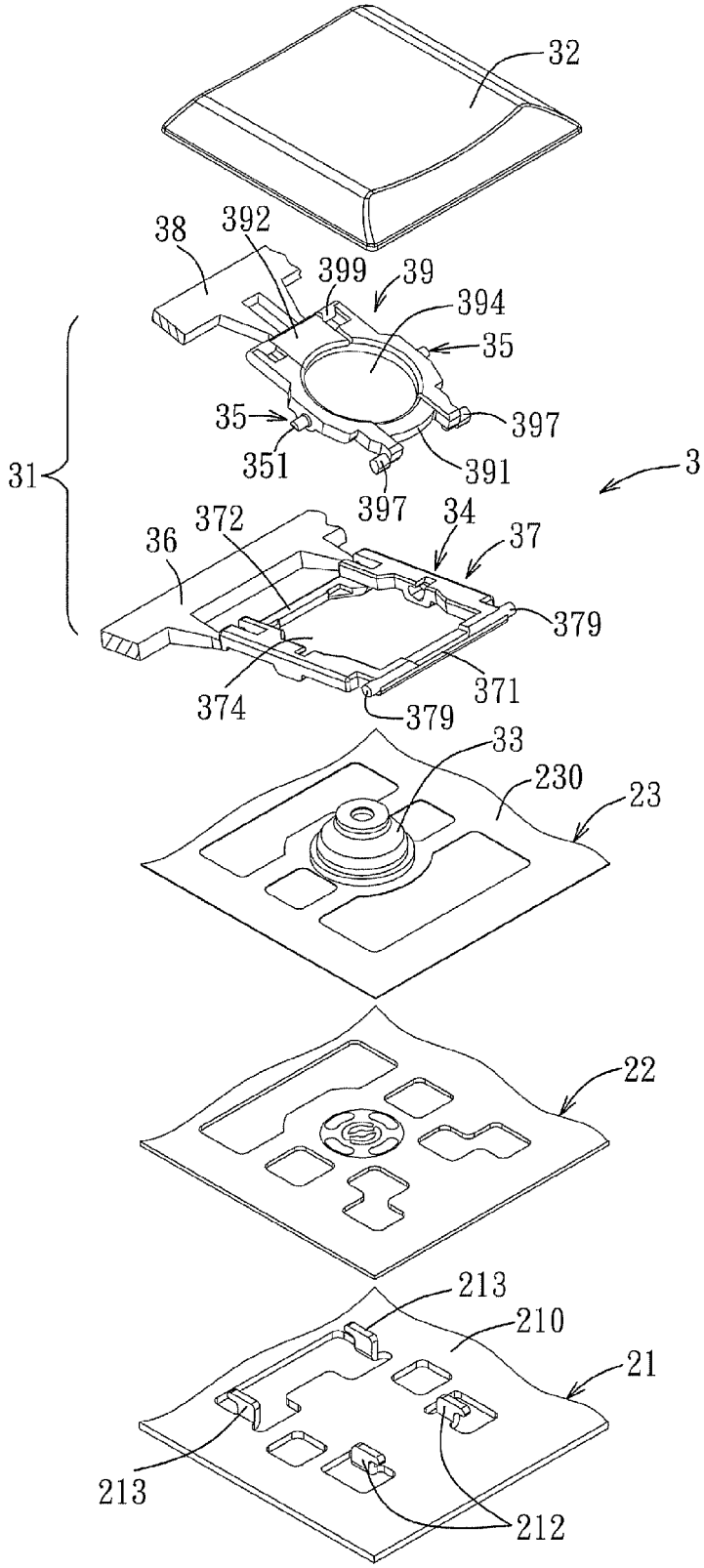
FIG. 3 is a fragmentary exploded perspective view of the preferred embodiment of a keyboard according to the present invention.
Figure 4:
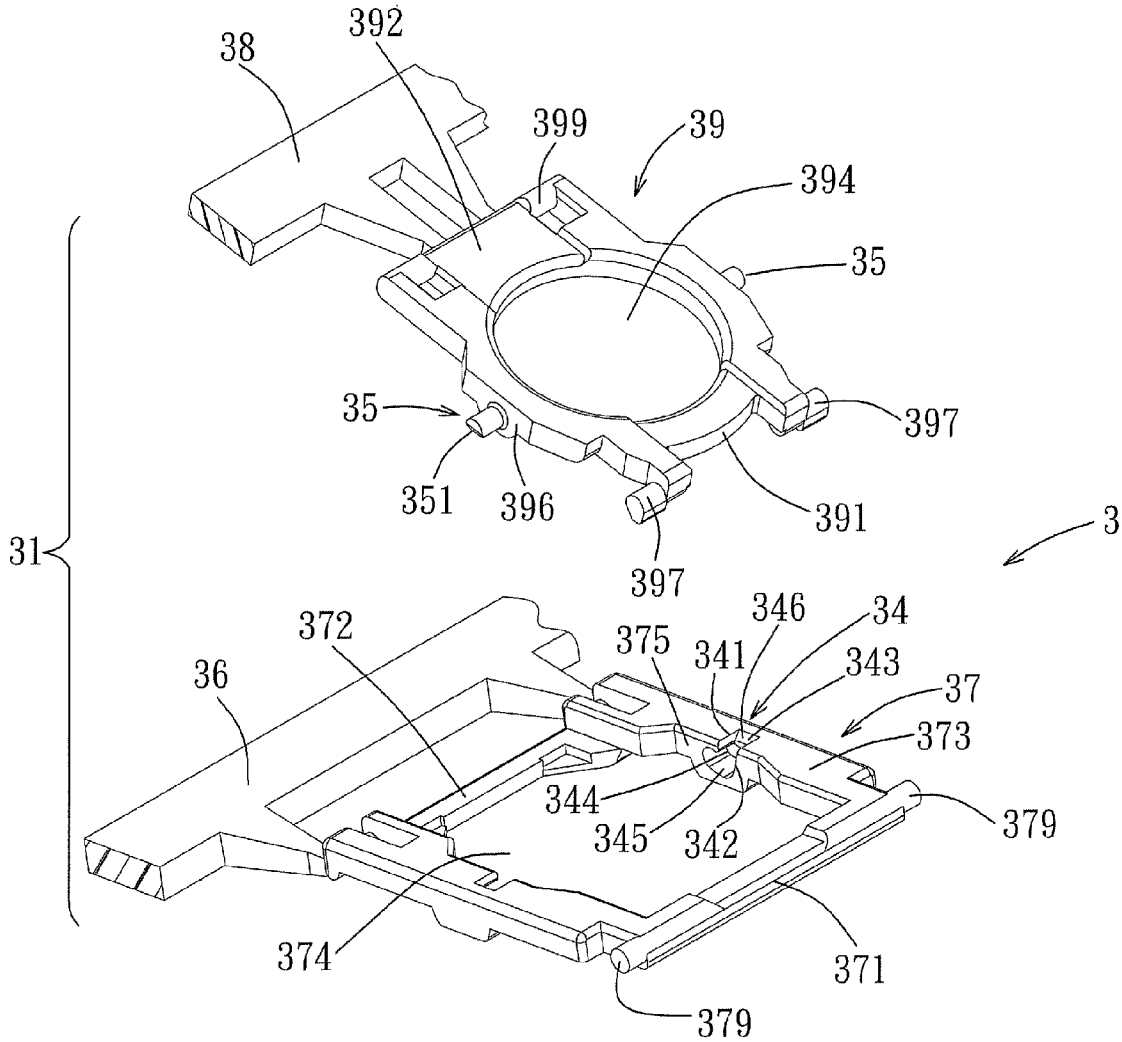
FIG. 4 is an enlarged exploded perspective view of a linkage assembly in the preferred embodiment.

Referring to FIGS. 3 and 4, an embodiment of a keyboard of the present invention comprises a keyboard base 21 made of metal, a membrane circuit substrate 22 disposed on the keyboard base 21, an elastic sheet 23 disposed on the membrane circuit substrate 22, and a press key set having a plurality of press keys 3 (only one is shown) disposed on the elastic sheet 23. Each of the press keys 3 includes a keycap 32, a linkage assembly 31, and an elastic element 33.

In each of the press keys 3, the linkage assembly 31 is disposed under the keycap 32 and includes intersecting first and second link levers 37, 39, and a first pivot mechanism to interconnect pivotally the first and second link levers 37, 39. The first and second link levers 37, 39 respectively define upper and lower ends 371, 372, 392, 391. The linkage assembly 31 further includes second and third pivot mechanisms that connect pivotally and respectively the upper ends 371, 392 of the first and second link levers 37, 39 to the keycap 32. The linkage assembly 31 further includes fourth and fifth pivot mechanisms that connect pivotally and respectively the lower ends 372, 391 of the first and second link levers 37, 39 to the keyboard base 21. By means of the linkage assembly 31, the keycap 32 is movable upwardly and downwardly relative to the keyboard base 21.

Figure 7:
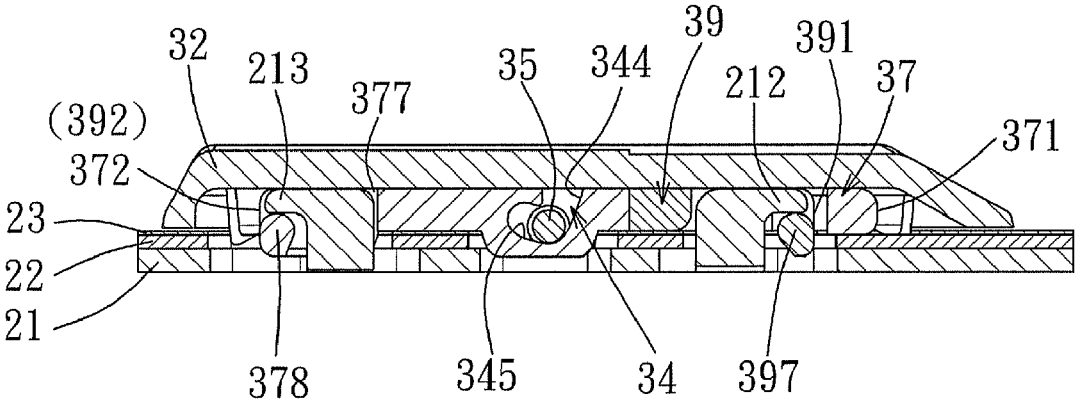
FIG. 7 is a view illustrating a keycap of the keyboard of FIG. 6 in a pressed state.

In each of the press keys 3, the elastic element 33 is connected to an upper surface 230 of the elastic sheet 23, passes upwardly through the linkage assembly 31 to connect with the keycap 32, and contacts the membrane circuit substrate 22 when the keycap 32 is in a pressed state (see FIG. 7).

In each of the press keys 3, the first and second link levers 37, 39 are respectively in a form of a frame, and respectively have a hollow portion 374, 394 therein through which the elastic element 33 passes to connect with the keycap 32.

The first pivot mechanism of each of the press keys 3 includes: a pair of female elements 34 formed in two opposite inner sides of the frame of the first link lever 37; and a pair of flexible male elements 35 formed in two opposite outer sides of the frame of the second link lever 39.

As shown in FIG. 4, in each of the press keys 3, each of the female elements 34 is a trench having a first opening 341 formed in a respective upper surface 373 of the first link lever 37 and a second opening 342 formed in a respective lateral side 375 of the first link lever 37. In each of the press keys 3, each of the male elements 35 is outwardly protruding from a respective lateral surface 396 of the second link lever 39.

Each of the trenches (i.e., the female elements 34) includes a front segment 343, a middle segment 344, and a pivot segment 345 in sequence from the first opening 341 toward the pivot segment 345. In each of the female elements 34, the front segment 343 extends from the first opening 341 and has a width wider than that of a respective male element 35 in a direction from the first opening 341 toward the pivot segment 345. In each of the female elements 34, the middle segment 344 is in spatial communication with the front segment 343 and tapers from the front segment 343 to have a narrower width than that of the respective male element 35 in a direction from the first opening 341 toward the pivot segment 345. In each of the female elements 34, the middle segment 344 defines an end portion adjacent to the pivot segment 345, and the pivot segment 345 is in spatial communication with the middle segment 344 and abruptly bends backward from the end portion of the middle segment 344 toward the front segment 343 to have a wider width than that of the respective male element 35 in a direction from the first opening 341 toward the pivot segment 345.

In a corresponding pair of male and female elements 35, 34, they are configured such that after the male element 35 is put into the front segment 343 of the female element 34 via the first opening 341 and is elastically deformed to be vertically pressed and to pass through the middle segment 344 toward the pivot segment 345, the male element 35 is restored to its original form to be limited in the pivot segment 345 of the female element 34. In short, in the present invention, each of the male elements 35 is upwardly or downwardly, not sidewardly, pressed into the respective female element 34.

Preferably, each of the female elements 34 has an inclined plane 346 facing the second opening 342, and each of the male elements 35 has an inclined plane 351 that tapers from a position adjacent to a joint of the male element 35 and the second link lever 39 toward an end point of the second link lever 39. In each of the linkage assemblies 31, when the second link lever 39 is disposed on and to downwardly overlay with the first link lever 37, the inclined planes 346 of the female elements 34 and the inclined planes 351 of the male elements 35 are fitted with each other. Through such an arrangement, when the second link lever 39 is disposed on and to overlay with the first link lever 37, the inclined planes 351 of the male elements 35 can be guided by the inclined planes 346 of the female elements 34 so as to facilitate the insertion of the male elements 35 into the female elements 34.

Thus, assembling each of the linkage assemblies 31 can be simply conducted by overlaying the first and second link levers 37, 39, followed by application of a press force, which is much easier than that of the prior art.

In each of the linkage assemblies 31, one of the first and second link levers 37, 39 is almost fully accommodated into the hollow portion 374, 394 of another one of the first and second link levers 37, 39, when the keycap 32 in each of the press keys 3 is pressed to its extremity. In this embodiment, as shown in FIG. 7, the second link lever 39 of each of the linkage assemblies 31 is configured to be fully accommodated into the hollow portion 374 of the respective first second link lever 37.

In each of the linkage assemblies 31, each of the second, third, fourth and fifth pivot mechanisms includes two means that are capable of snap fitting each other in a vertical direction (not sidewardly), and preferably is a hook-shaft engagement mechanism that includes a hook and a locking shaft.

Figure 5:
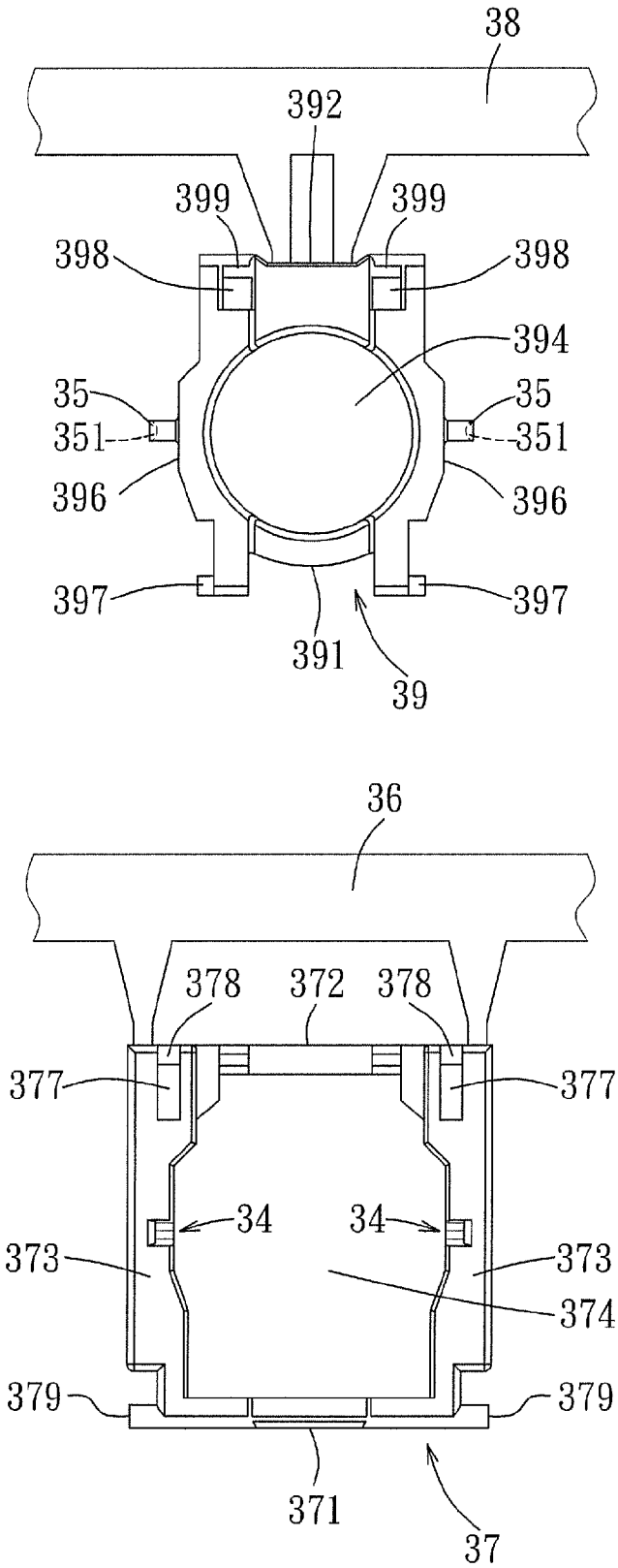
FIG. 5 is a plane view respectively illustrating first and second link levers in the linkage assembly of FIG. 4.
Figure 6:
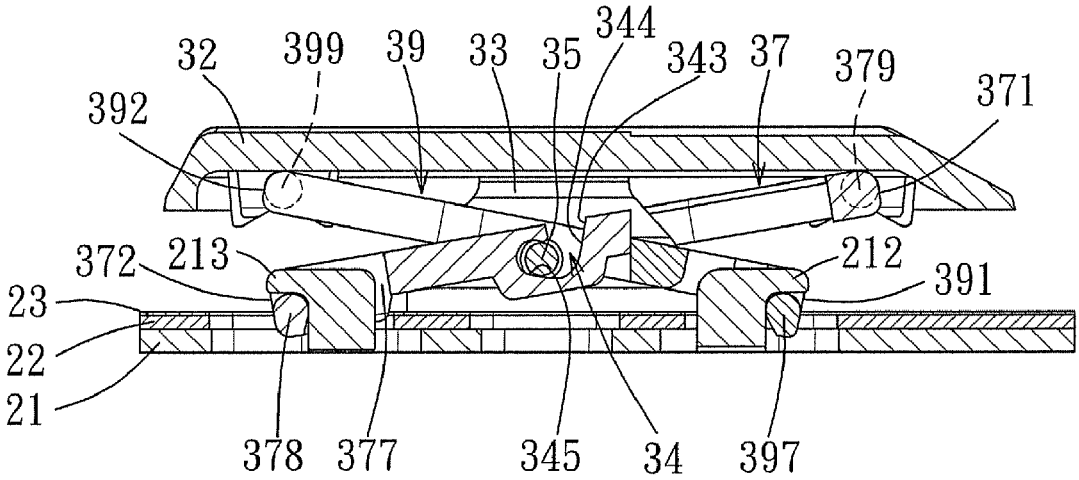
FIG. 6 is a fragmentary cross-sectional view of the keyboard of FIG. 3 in an assembled state.

Referring to FIGS. 3, 5, and 6, preferably, in each of the press keys 3, the fourth pivot mechanism includes a pair of locking shafts 378 formed in a pair of holes 377 located near the lower end 372 of the first link lever 37, and a pair of hooks 213 formed on an upper surface 210 of the keyboard base 21. The fifth pivot mechanism includes a pair of locking shafts 397 formed on the lower end 391 of the second link lever 39, and a pair of hooks 212 formed on the upper surface 210 of the keyboard base 21.

In the present invention, the pivot connection between one linkage assembly 31 and the keyboard base 21 is conducted by abutting the pair of hooks 213 of the fourth pivot mechanism against the pair of locking shafts 378 of the fourth pivot mechanism, respectively, followed by pressing the whole linkage assembly 31 downwardly such that the pair of locking shafts 397 of the fifth pivot mechanism are elastically deformed to be snap fitted into the pair of the hooks 212 of the fifth pivot mechanism, respectively. It should be noted that since the locking shafts 378, 397 of the first and second link levers 37, 39 are always limited in the hooks 212, 213 on the keyboard base 21 regardless of the state of the linkage assemblies 31, the locking shafts 397 cannot be pressed into the hooks 212 if there is no elastic deformation of the locking shafts 397. After the locking shafts 397 are pressed into the hooks 212, the locking shafts 397 are restored to their original form to be limited by the hooks 212.

Since both of the fourth and fifth pivot mechanisms are hook-shaft engagement mechanisms, they can be configured such that when the hooks and the locking shafts of the hook-shaft engagement mechanism of one of the fourth and fifth pivot mechanisms are engaged to each other, the hooks and the locking shafts of the hook-shaft engagement mechanism of another one of the fourth and fifth pivot mechanisms can be snap fitted to engage each other.

Furthermore, the hooks and the locking shafts of the fourth and fifth pivot mechanisms should not be limited to the above arrangement. For example, the hooks of the fourth pivot mechanism can be formed on one of the lower end 372 of the first link lever 37 and the upper surface 210 of the keyboard base 21, and the locking shafts of the fourth pivot mechanism can be formed on another one of the lower end 372 of the first link lever 37 and the upper surface 210 of the keyboard base 21. The hooks of the fifth pivot mechanism can be formed on one of the lower end 391 of the second link lever 39 and the upper surface 210 of the keyboard base 21, and the locking shafts of the fifth pivot mechanism can be formed on another one of the lower end 391 of the second link lever 39 and the upper surface 210 of the keyboard base 21.

Although the second and third pivot mechanisms are not completely shown in FIGS. 3, 5 and 6, they are somewhat similar to the fourth and fifth pivot mechanisms.

In detail, in each of the press keys 3, the third pivot mechanism includes a pair of locking shafts 399 formed in a pair of holes 398 located near the upper end 392 of the second link lever 39, and a pair of hooks formed on a lower surface of the keycap 32. The second pivot mechanism includes a pair of locking shafts 379 formed on the upper end 371 of the first link lever 37, and a pair of hooks formed on the lower surface of the keycap 32.

The pivot connection between one linkage assembly 31 and one keycap 32 is similar to that between one linkage 31 and the keyboard base 21. In the preferred embodiment, the pivot connection is conducted by abutting the pair of hooks of the third pivot mechanism formed on the lower surface of the keycap 32 against the pair of locking shafts 399 of the third pivot mechanism, respectively, followed by downwardly pressing the keycap 32 to cover the whole linkage assembly 31 such that the pair of locking shafts 379 of the second pivot mechanism are elastically deformed to be snap fitted into the pair of the hooks of the second pivot mechanism formed on the lower surface of the keycap 32, respectively. Since snap-fitting of the locking shafts 379 of the second pivot mechanism into the hooks of the second pivot mechanism is the same as that described above, further details thereof are omitted herein for the sale of brevity.

Figure 8:
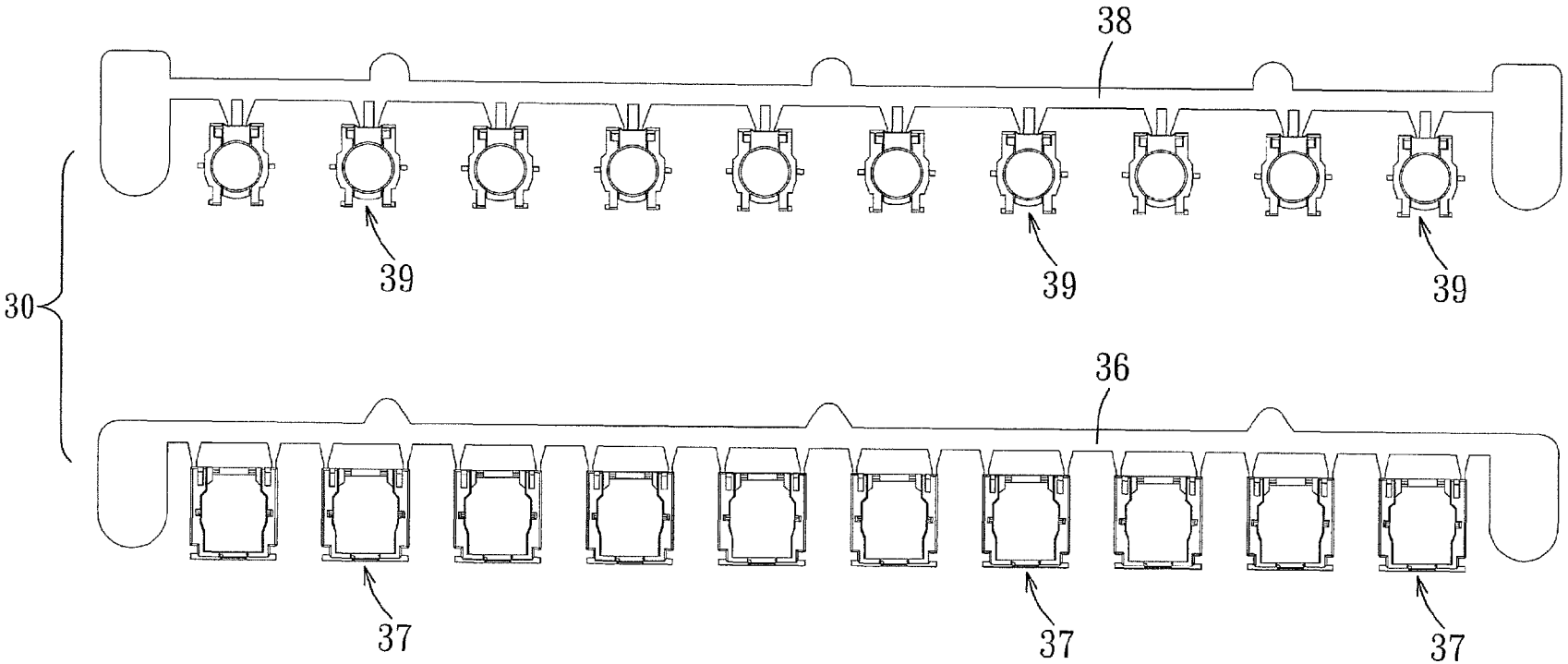
FIG. 8 is an exploded plane view of a linkage assembly set according to the preferred embodiment.
Figure 9:
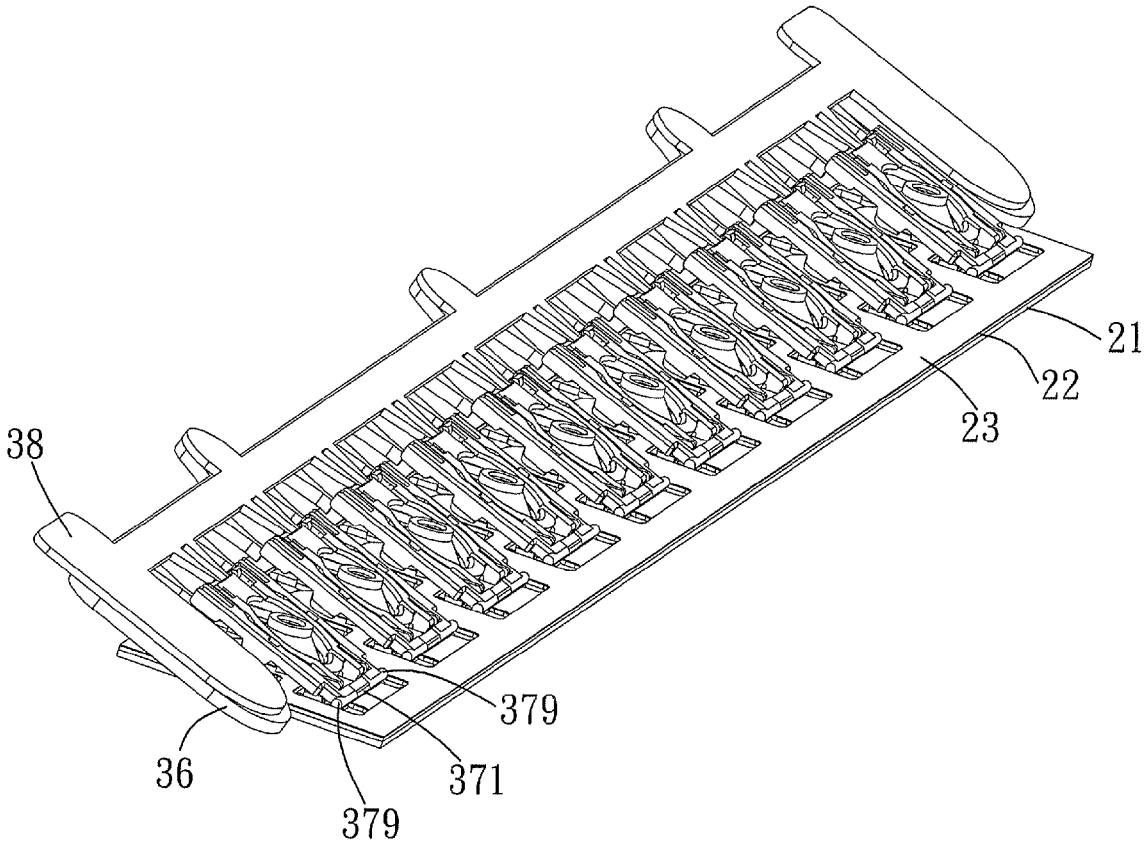
FIG. 9 is a perspective view illustrating the linkage assembly set of FIG. 8 in an assembled state.

Referring to FIGS. 8 and 9, a linkage assembly set 30 for coupling a plurality of keycaps 32 to a keyboard base 32 of a keyboard is also provided in this invention.

In the present invention, the linkage assembly set 30 means a structure for mounting a plurality of linkage assemblies on an assembly of the keyboard base 21, the membrane circuit substrate 22 and the elastic elements 33 row by row.

The linkage assembly set 30 includes a plurality of linkage assemblies 31, and first and second bridging elements 36, 38. Each of the linkage assemblies 31 in the linkage assembly set 30 and that in the keyboard according to the present invention are identical in structure. The first link levers 37 in each of the linkage assemblies 31 are connected to one another by virtue of the first bridging element 36 to be arranged in a row. The second link levers 39 in each of the linkage assemblies 31 are connected to one another by virtue of the second bridging element 38 to be arranged in a row.

The linkage assembly set 30 can be assembled by simply disposing each of the second link levers 39 on a respective first link lever 37 and to downwardly overlay therewith, putting each of the male elements 35 into the front segment 343 of the respective female element 34, pressing each of the male elements 35 vertically such that each of the male elements 35 is elastically deformed to pass through the middle segment 344 toward the pivot segment 345 of the respective female element 34, followed by limiting each of the male elements 35 in the pivot segment 345 of the respective female element 34 while each of the male elements 35 is restored to its original form. Therefore, by the provision of the linkage assembly set 30, it is feasible to provide the linkage assemblies 31 row by row on the keyboard base 21.

There is also provided a method of assembling a keyboard, which includes the steps of:

(a) preparing a plurality of the aforesaid linkage assembly sets 30, each of which is identical to the aforesaid one;

(b) disposing a membrane circuit substrate 22 on a keyboard base 21;

(c) disposing a plurality of elastic elements 33 on the membrane circuit substrate 22;

(d) mounting the linkage assembly sets 30 on an assembly of the keyboard base 21, the membrane circuit substrate 22 and the elastic elements 33 row by row, such that each of the linkage assemblies 31 permits one of the elastic elements 33 to pass upwardly therethrough; and (e) mounting a plurality of keycaps 32 onto the linkage assemblies 31 such that each of the keycaps 32 is mounted on one of the linkage assemblies 31.

Preferably, in step (d), after one of the linkage assembly sets 30 is mounted on the assembly of the keyboard base 21, the membrane circuit substrate 22 and the elastic elements 33, the first and second bridging elements 36, 38 are removed from said one of the linkage assembly sets 30, followed by mounting another one of the linkage assembly sets 30 on the assembly of the keyboard base 21, the membrane circuit substrate 22 and the elastic elements 33.

It should be noted that since the pivot connection between each of the linkage assemblies 31 and the keyboard base 21 can be conducted by the aforesaid hook-shaft engagement mechanisms of the fourth and fifth pivot mechanisms, it is feasible to mount the linkage assemblies 31 row by row by virtue of the linkage assembly sets 30.

Furthermore, it is also feasible to mount the keycaps 32 row by row by virtue of a plurality of keycap sets each of which includes a plurality of keycaps 32 arranged in a row, since the pivot connection between each of the linkage assemblies 31 and the respective keycap 32 can be conducted by the aforesaid hook-shaft engagement mechanisms of the second and third pivot mechanisms.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A linkage assembly set for coupling a plurality of keycaps to a keyboard base of a keyboard, said linkage assembly set comprising a plurality of linkage assemblies and first and second bridging elements, wherein:

each of said linkage assemblies includes intersecting first and second link levers that are interconnected pivotally;

said first link levers in each of said linkage assemblies are connected to one another by virtue of said first bridging element to be arranged in a row;

said second link levers in each of said linkage assemblies are connected to one another by virtue of said second bridging element to be arranged in a row;

said first link lever includes a female element having a first opening formed in one of upper and lower surfaces of said first link lever, and said second link lever includes a flexible male element outwardly protruding from a lateral surface of said second link lever; and said male and female elements are configured such that after said male element is elastically deformed to be pressed into said female element via said first opening, said male element is restored to its original form to be limited in said female element, and said first and second link levers are interconnected pivotally.

2. The linkage assembly set of claim 1, wherein:

said female element further has a second opening formed in at least one lateral side of said first link lever so as to form a trench having said first and second openings;

said trench includes a front segment, a middle segment, and a pivot segment in sequence from said first opening toward said pivot segment;

said front segment extends from said first opening and has a width wider than that of said male element in a direction from said first opening toward said pivot segment;

said middle segment is in spatial communication with said front segment and tapers from said front segment to have a narrower width than that of said male element in a direction from said first opening toward said pivot segment; and said pivot segment is in spatial communication with said middle segment and bends from said middle segment to have a wider width than that of said male element in a direction from said first opening toward said pivot segment.

3. The linkage assembly set of claim 2, wherein said middle segment defines an end portion adjacent to said pivot segment, and said pivot segment abruptly bends backward from said end portion of said middle segment toward said front segment.

4. A method of assembling a keyboard, comprising the steps of:

(a) preparing a plurality of linkage assembly sets, each of which includes a plurality of linkage assemblies and first and second bridging elements, each of the linkage assemblies including intersecting first and second link levers that are interconnected pivotally, the first link levers in each of the linkage assemblies being connected to one another by virtue of the first bridging element to be arranged in a row, the second link levers in each of the linkage assemblies being connected to one another by virtue of the second bridging element to be arranged in a row;

(b) disposing a membrane circuit substrate on a keyboard base;

(c) disposing a plurality of elastic elements on the membrane circuit substrate;

(d) mounting the linkage assembly sets on an assembly of the keyboard base, the membrane circuit substrate and the elastic elements row by row, such that each of the linkage assemblies permits one of the elastic elements to pass upwardly therethrough; and (e) mounting a plurality of keycaps onto the linkage assemblies such that each of the keycaps is mounted on one of the linkage assemblies; wherein:

the first link lever includes a female element having a first opening formed in one of upper and lower surfaces of the first link lever, and the second link lever includes a flexible male element outwardly protruding from a lateral surface of the second link lever; and the male and female elements are configured such that after the male element is elastically deformed to be pressed into the female element via the first opening, the male element is restored to its original form to be limited in the female element, and the first and second link levers are interconnected pivotally.

5. The method of claim 4, wherein, in step (d), after one of the linkage assembly sets is mounted on the assembly of the keyboard base, the membrane circuit substrate and the elastic elements, the first and second bridging elements are removed from said one of the linkage assembly sets, followed by mounting another one of the linkage assembly sets on the assembly of the keyboard base, the membrane circuit substrate and the elastic elements.

* * * * *